United States Patent [19]

Ottestad

[11] Patent Number: 4,793,340

[45] Date of Patent: Dec. 27, 1988

[54] BREATHING SYSTEM FOR DIVERS

[75] Inventor: Nils T. Ottestad, Tonsberg, Norway

[73] Assignee: Den Norske Stats Oljeselskap A.S., Stavanger, Norway

[21] Appl. No.: 908,105

[22] Filed: Sep. 16, 1986

[30] Foreign Application Priority Data

Sep. 18, 1985 [NO] Norway ..... 853654

[51] Int. Cl.[4] ..... B63C 11/02

[52] U.S. Cl. ..... 128/200.24; 128/200.29; 128/201.27; 128/204.26; 128/204.28; 128/205.13; 128/205.16

[58] Field of Search ..... 128/200.24, 200.29, 128/201.27, 204.18, 204.26, 204.28, 205.24, 205.13, 205.16

[56] References Cited

U.S. PATENT DOCUMENTS 3,556,095 1/1971 Ismach ..... 128/204.28
4,567,889 2/1986 Lehmann ..... 128/204.28

FOREIGN PATENT DOCUMENTS 461329 2/1937 United Kingdom ..... 128/205.13

*Primary Examiner*—Edward M. Coven
*Assistant Examiner*—J. P. Lacyk
*Attorney, Agent, or Firm*—Banner, Birch, McKie and Beckett

[57] ABSTRACT

"A breathing system for divers includes a breathing bag (211) from which the inhalation gas to the diver is delivered and to which the exhalation gas from the diver is supplied, a compressed gas source for the supply of breathing gas, and a pneumatic cylinder/piston unit (308, 209) operatively connected to the compressed bag source and having the piston (209) coupled to the breathing bag (211) to contract or expand the bag. A sensor responds to pressure variations in the breathing gas caused by the diver's inhalation and exhalation, and causes at least two valves and associated controls (173–205) to switch the compressed gas source to either side of the piston (209) in the pneumatic cylinder (208). The valves (176, 177) ensure that the breathing gas to and from the diver is maintained at a pressure approximately equal to the ambient pressure. When the sensor particularly comprises a diaphragm (170), the valve controls may be arranged to provide for increasing or decreasing the high-pressure gas flow supplied to the pneumatic cylinder (208) in dependence on the extent of movement of the diaphragm (170) in the direction in question."

10 Claims, 8 Drawing Sheets

BREATHING SYSTEM FOR DIVERS

The present invention relates to a breathing system for divers, comprising a so-called breathing bag from which the inhalation gas to the diver is delivered and to which the exhalation gas from the siver is supplied, and a compressed gas source for the supply of breathing gas.

A common characteristic of breathing systems which are to be used on large depths, is that they take care of exhaled gas and see that this is purified of carbon dioxide and supplied with fresh oxygen, so that it may again be used as breathing gas. The reason for this is that helium, which constitutes the major part of the breathing gas, is very expensive. It is common to distinguish between surface-oriented and bell- or diver-oriented gas recovery systems. In the first-mentioned type, the recovery system is located at the surface, and the gas again must be compressed before it is sent down to the diver. Such systems may have a good capacity but they require much energy. Bell- and diver-oriented recovery systems require less energy, but here it may often be capacity and space problems. The diving bells are small, and it is also limited with what the diver can be equipped since he shall be mobile and be able to get relatively easily into and out of the bell.

According to what one knows, there is today no commercial breathing system which entirely satisfies the demands made on commercial diving don to depths of 300–500 meters. One of the greatest problems is to provide satisfactory emergency breathing systems, i.e. systems which can provide the diver with breathing gas if a breakage occurs in the ordinary supply leads. The breathing system shall take care that the diver is ensured breathing gas so that he gets back to the diving bell where there are relatively large gas reserves.

A general problem with existing emergency breathing systems is that they have either a too small gas reserve or they are too heavy to breathe with. Further, it has often turned out to be difficult to incorporate the emergency breathing system in the ordinary breathing system in a suitable manner.

In some diving systems, the emergency breathing system simply consists of one or more pressure bottles with reserve gas which is carried by the diver on his back, and which the diver connects if the normal supply drops out. This may be a good solution in the case of shallow dives, but when staying at large depths the pressure bottles will be emptied in a very short time.

Another, and more accepted solution, is "semiclosed" emergency breathing systems. Here the diver breathes into and out of a bellows (breathing bag). Exhaled gas is directed through an absorber removing the carbon dioxide, and a means seeing that the gas is supplied with a certain amount of oxygen. With this solution, it is in principle only the oxygen consumption which shall be compensated for, and the duration of the emergency system can be increased radically. The big problem is, however, that this system is relatively heavily breathed because the diver's own lungs must push the gas into and out of the breathing bag. Semi-closed systems are commercially available also as combined primary and emergency breathing systems.

It is an object of the invention to provide a breathing system of the semi-closed type wherein the system functiones as a demand system and thus makes the system easily breathed.

A further object is to provide a breathing system which has a good capacity at the same time as it is easily breathed, and which also is precise and gives the possibility of an effective utilization of the gas.

The above-mentioned objects are achieved with a breathing system of the introductorily stated type which, according to the invention, is characterized in that it comprises a pneumatic cylinder/piston unit which is connected to the compressed gas source and of which the piston is operatively coupled to the breathing bag to compress or expand the bag, a sensing means arranged to respond to pressure variations in the breathing gas caused by the inhalation and exhalation of the diver, a switching means arranged to be affected by the sensing means, so that it switches the compressed gas source to either side of said piston in accordance with the breathing pattern of the diver, and a control means arranged to maintain a stable pressure approximately equal to the ambient pressure in the breathing gas to respectively from the diver.

An advantageous embodiment of the breathing system according to the invention is characterized in that the sensing means comprises a diaphragm arranged to move in opposite directions in dependence on whether the diver inhales or exhales, and which affects the switching means so that it provides the breathing bag with an essentially fixed overpressure during the diver's inhalation, and correspondingly with an essentially fixed negative pressure during the exhalation, the control means being a low-pressure demand regulator controlling the inhalation and exhalation of the diver.

Another advantageous embodiment of the breathing system according to the invention is characterized in that the sensing means comprises a diaphragm which is arranged to move in opposite directions in dependence on whether the diver inhales or exhales, and which is operatively coupled to the switching means so that high-pressure gas is supplied through the switching means to either side of the piston in dependence on the movement direction of the diaphragm, and that the control means is arranged to provide for increasing or decreasing the high-pressure gas flow supplied to the pneumatic cylinder, in dependence on the extent of movement of the diaphragm in the direction in question.

Thus, in the last-mentioned embodiment, the sensing diaphragm is coupled to a mechanism controling the high-pressure gas to the pneumatic cylinder so that the breathing bag does not have a larger overpressure or negative pressure, respectively, than what is necessary in order for the breathing gas to be able to be directed to and from the diver through approximately open hose connections. (What prevents the gas flow, mainly is absorbent for carbon dioxide and one-way valves forming part of the system.) The embodiment is not dependent on a separate low-pressure demand regulator for fine adjustment of the breathing gas flow. In the reality, the sensing diaphragm will here, together with the control mechanism for the pneumatic cylinder and the breathing bag, jointly function as a demand regulator.

In both of said embodiments the switching between inhalation and exhalation can take place very quickly. The breathing system functions as a demand system, and not as in the previously known systems wherein the diver has to push the gas into and out of a breathing bag (counterlungs) by his own force. The necessary overpressure or negative pressure, respectively, is produced by means of the pneumatic cylinder, supplied gas with overpressure being used to control the cylinder.

A further embodiment of the system according to the invention is characterized in that the sensing means is arranged to sense when the diver's inhalation phase and exhalation phase, respectively, is finished, so that the switching means switches the compressed gas source alternately to opposite sides of said piston after finished inhalation and exhalation, respectively, and that the control means comprises a demand regulator arranged to control inhalation and exhalation at a low overpressure and a low negative pressure, respectively, in the breathing bag.

This embodiment is different from the first-mentioned embodiments in that the switching means changes to the opposite breathing phase, i.e. from inhalation to exhalation or vice versa, if the diver holds his breath for a moment. However, this is no drawback of significance and such an embodiment of the breathing system has shown to function very well in practice.

Thus, in the system according to the invention, overpressure in the gas supply is used to produce overpressure and negative pressure, respectively, in the breathing bag in accordance with the breathing pattern of the diver. The breathing bag turns to overpressure when the diver is to inhale, and when he has finished the inhalation the breathing bag turns to "suction", in order to accept the gas blown out by the diver. When the supplied high-pressure gas has carried out the task of compression and expansion, respectively, of the breathing bag, it is introduced, completely or partly, into the breathing bag to compensate for the consumption of oxygen, loss of helium, etc.

The breathing system according to the invention can be used as a primary as well as an emergency breathing system. In practice, the system will be provided with a means taking care that exhaled gas is purified of $CO_2$ and supplied with fresh gas as a compensation for gas which has been consumed or has leaked out to the surroundings. Further, there will provided a humidifier unit supplying the inhalation gas with a certain amount of heated water vapour. Since it is advantageous to the diver that the inhalation gas is humid and warm, tha humidifier unit has an important function in the system.

Normally, the system will include a back-pack wherein the breathing bag, a $CO_2$ scrubber, a reserve gas bottle and a humidifier unit are incorporated. Advantageously, the back-pack can be provided with through-flowing warm water, as this reduces delivery of heat from the breathing gas to the surroundings, and makes the $CO_2$ scrubber more effective. In addition, the warm water is led through the special humidifier unit of the system.

The invention will be further described below in connection with exemplary embodiments with reference to the drawings, wherein

BRIEF DESCRIPTION OF DRAWINGS

In FIGS. 1 and 2 there is shown a breathing bag 1 formed by a pair of essentially parallel, rigid side plates 2, 3 and an encircling connection member or side edge member 4 of a rigid, resilient material, e.g. rigid rubber. A pneumatic cylinder/piston unit 5 which is coupled to a compressed gas source (45 in FIG. 3), is arranged in operative connection with the breathing bag 1. The unit comprises a cylinder 6 which, with a bottom portion, is fixed to one side plate 3 of the breathing bag, and a piston 7 having a piston rod 8 extending through the side plate 3 and being fixed with its end to the other side plate 2, e.g. by means of the shown nut 9.

Figure 1:
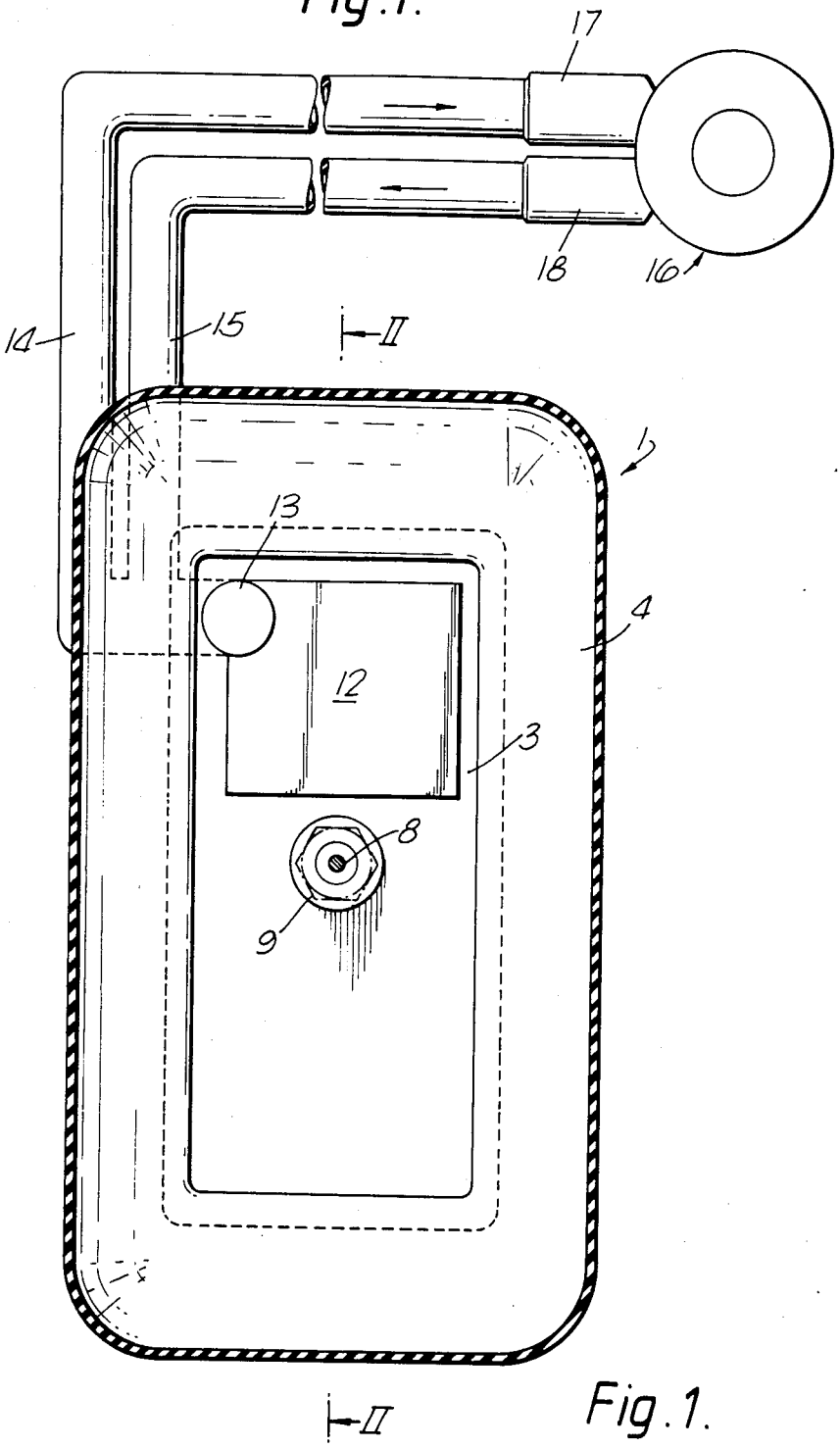
FIG. 1 shows a schematic view of a breathing bag with co-operating units in an embodiment of an emergency breathing system according to the invention, the bag being shown in section along the line I—I in FIG. 2.

The task of the cylinder/piston unit 5 is to push the side plates of the breathing bag alternately towards and away from each other in accordance with the breathing of the diver. To illustrate the advantages of this solution, an example will be described below.

It is assumed that the effective area of the stiff side plates 2, 3 is 800 $cm^2$, and that the overpressure and the negative pressure, respectively, in the breathing bag is wanted to be 0,1 atm. and −0,1 atm. This means that the force with which the piston is pushing, must be 80 kp. Further, it is assumed that the diver in a given breathing cycle breathes and blows out 4 liters of gas. This implies that the piston must be moved 5 cm inwards and 5 cm backwards. In this case it is chosen that the overpressure of the gas supplied to the pneumatic cylinder is reduced to an overpressure of 20 atmospheres (the pressure in the gas bottle initially will be e.g. 300 atm.). Thus, the effective area of the piston must be 4 $cm^2$ in order to achieve the desired force, viz. 80 kp. In order that the breathing bag in this case shall be able to deliver 4 liters of gas with an overpressure of 0,1 atm., and thereafter suck the gas back with a negative pressure of 0,1 atm., the pneumatic cylinder thus must be supplied with $4\ cm^2 \times 5\ cm \times 2 = 40\ cm^3$ of gas with an overpressure of 20 atm. When diving at a depth of 400 meters, the surrounding pressure is approximately 40 atm. Thus, at this depth, the diver, in order to breathe and blow out 4 liters of gas with a pressure of 40 atm., must allow the pneumatic cylinder to consume a gas quantity which, referred to 40 atm., corresponds to 60 $cm^3$. This gas quantity is more than sufficient in order to be able to compensate for the oxygen consumption, which means that some gas must be dumped into the sea. This loss is without any importance from an economic viewpoint. Besides, the loss is so small that a satisfactory capacity of the emergency breathing system is achieved without any problems.

The necessary quantity of supplied gas is here approximately 1,5% of the effective breathed volume. Thus, a pressure bottle containing 5 liters of reserve gas with a pressure of 200 atm. will, at a depth of 400 meters, deliver approximately 18 liters of gas which can be fully utilized by the pneumatic cylinder. This should give a respiration volume corresponding to 1,2 $m^3$ (referred to a depth of 400 m). Thus, with a gas consumption of 40 liters per minute, this emergency system provides the diver with breathing gas for 30 minutes.

Figure 2:
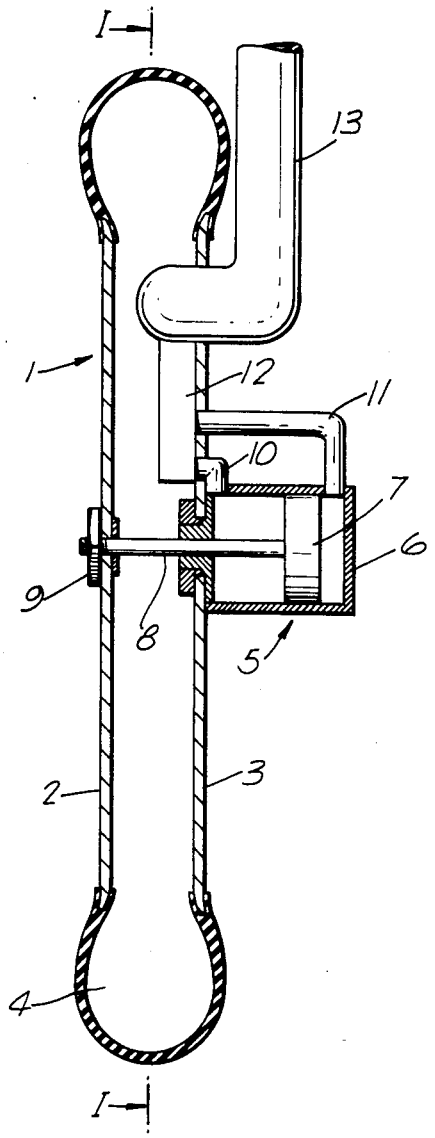
FIG. 2 shows a section along the line II—II in FIG. 1.

As appears from FIG. 2, the cylinder 6 at its ends is connected to respective inlets 10 and 11, respectively, communicating with corresponding outlets in the system's switching means which, in FIGS. 1 and 2, is schematically suggested to be located within the breathing bag and is designated by the reference numeral 12.

The breathing bag 1 is shown to be provided with an inlet/outlet connecting tube 13 which, at one end, communicates with the switching means 12 and at its other end passes into a pair of conduits 14 and 15 provided with one-way valves (not shown) and communicating with a demand regulator 16 which is designed as a double-acting demand breathing valve, as described in detail in connection with FIGS. 6 and 7. One conduit 14 conveys gas from the breathing bag 1 through the humidifier unit of the system and the $CO^2$ scrubber (not shown) to an inhalation valve 17 forming part of the breathing valve, whereas the other conduit 15 conveys exhaled gas from an exhalation valve 18 back to the breathing bag 1.

Normally, the breathing bag will be provided with a means providing for draining-off (dumping) of excess gas when the total volume in the system exceeds a certain value. This means is not shown in FIGS. 1 and 2, but will be described with reference to FIG. 4.

Figure 3:
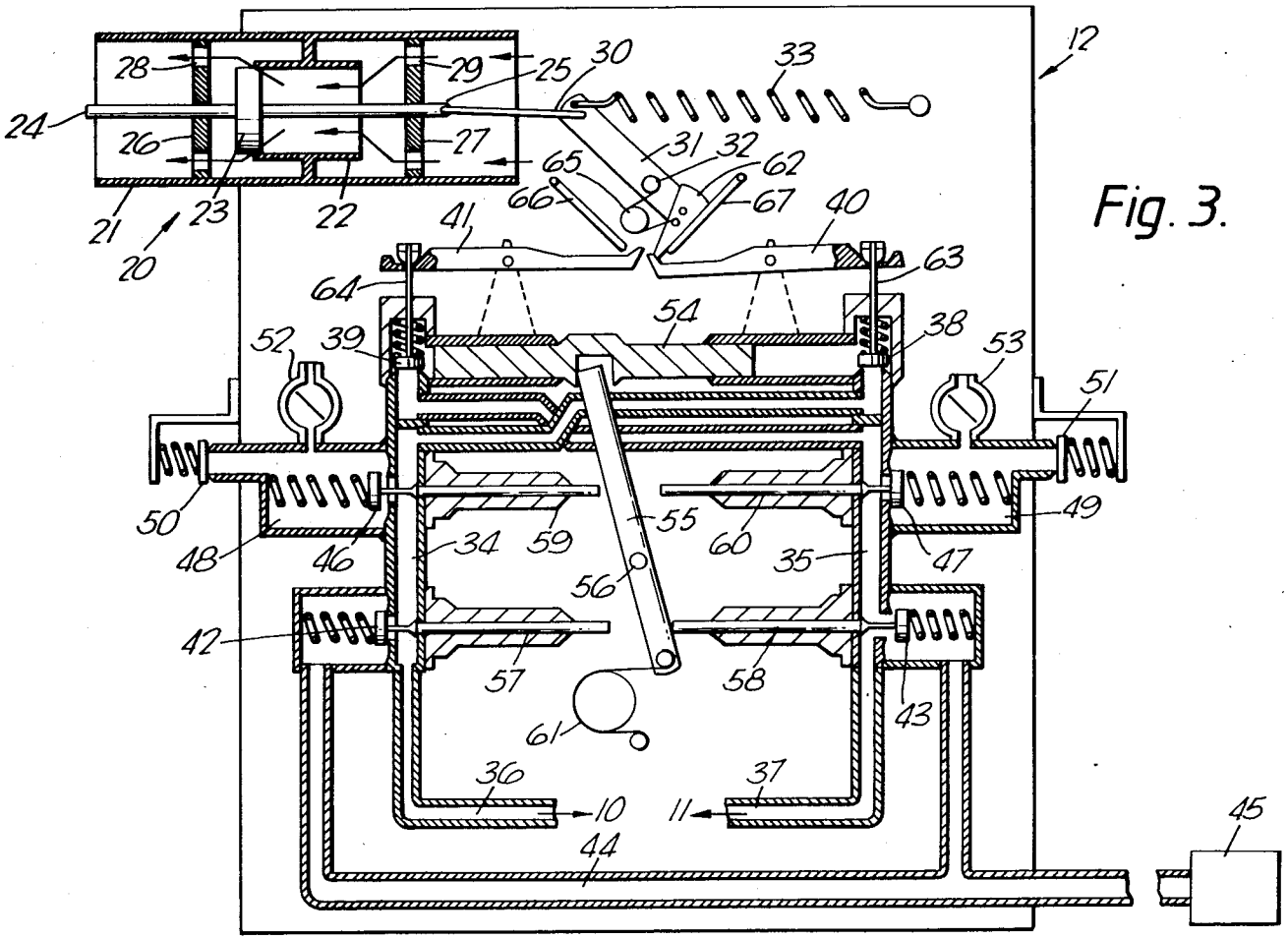
FIG. 3 shows a sectional view of an embodiment of a sensing means and a switching means in the breathing system according to FIGS. 1 and 2.

FIG. 3 shows an embodiment of the switching means 12 and also of the sensing means which, in this embodiment, is arranged to sense when the diver's inhalation phase and exhalation phase, respectively, is finished.

The sensing means 20 is connected between the switching means 12 and the inlet/outlet connecting tube 13 of the breathing bag and comprises a hollow cylinder body 21 which then, at one end, communicates with the demand regulator 16 of the system through the conduits 14 and 15. The cylinder body 21 contains a cylindrical channel 22 having a piston 23 which is slidable therein. The piston has oppositely directed piston rods 24, 25 guided in respective holes in a pair of transverse walls 26, 27 provided in the cylinder body 21 on either side of the channel 22 and provided with a plurality of holes 28, 29 for throughflow of gas. The free end of the piston rod 25 is connected through a stirrup 30 with one end of a pivot arm 31 forming part of the switching means and being rotatable about a stationary shaft 32. Said end of the pivot arm is also connected to one end of a helical spring 33 which is arranged to move the piston 23 to an intermediate position in the channel 22 when no gas is flowing through the channel and the piston thus is not affected by any pressure force from flowing gas.

As appears from FIG. 3, the switching means includes a first and a second chamber 34 and 35, respectively, having outlets 36 and 37 which, as mentioned above, are in open connection with respective ones of the inlets 10, 11 to the pneumatic cylinder 6. Further, the chambers 34, 35 communicate with a respective switching valve 38, and 39, respectively, which is arranged to be affected by an associated actuater means 40, 41 at the time of finished inhalation and finished exhalation, respectively, and through a respective, further valve 42, 43 the chambers communicate with a conduit 44 extending through the compressed gas source 45 of the system. The chambers 34, 35 are also provided with outlet valves 46, 47 for the outlet of high-pressure gas to respective chambers 48, 49 of which each is provided with an overpressure valve 50 and 51, respectively, for the outlet of high-pressure gas to the surroundings, and also with a means (e.g. a suitable controlled valve) 52 and 53, respectively, taking care that the breathing bag 1 is supplied with a desired quantity of gas for maintaining the desired $O_2$ level and the total gas volume in the breathing bag.

As appears from FIG. 3, said valves are designed as disk valves having valve disks which are spring-loaded towards closed position of the valves.

Further, the switching means includes a piston 54 which is arranged to be driven in opposite directions when opening the two switching valves 38, 39, and which is coupled to a pivot arm 55 which is rotatable about a stationary shaft 56 and is arranged to operate the further valves 42, 43, 46, 47 of the chambers 34, 35 through respective valve stems 57–60 which are slidably mounted as suggested. When switching over the piston 54, the pivot arm 55 causes, as further described later on, that the compressed gas source is switched from one inlet 10 or 11 of the pneumatic cylinder 6 to the other one. A tension spring 61, functioning as a tilting switch, is arranged to maintain the pivot arm 55 in its new position after each switching.

Said actuator means 40, 41 affecting the switching valves 38, 39, are shown to consist of rotatably mounted levers having mutually adjacent ends which are arranged to be affected alternately, and more specifically tilted down, by a triangular tilting member 62 which is pivotally mounted at the lower end of the pivot arm 31 coupled to the sensing means 20. Each lever 40, 41 is connected at its other end to the valve disk of the associated switching valve 38, 39 through respective valve stems 63, 64.

In FIG. 3 the pivot arm 31 is shown in a position wherein it is rotated anticlockwise so that the lower end of the tilting member 62 rests on the adjacent end of the lever 40. This position is assumed by the pivot arm at inhalation, the piston 23 of the sensing means then moving to the left in the cylinder body 21 so that the channel 22 is opened for through-flow of gas in the direction from the breathing bag to the diver. At exhalation the piston 23 will be pushed to the right, so that the channel 22 is opened for gas flow in the direction from the diver to the breathing bag, and the pivot arm 31 is then rotated clockwise, so that the tilting member 62 is transferred from the lever 40 to the lever 41 and will be lying laterally reversed in relation to the position in FIG. 3. A tension spring 65 and a pair of guides 66 and 67 are provided as shown, to keep the tilting member 62 correctly oriented in any position of the pivot arm 31.

The operation of the switching means will be further described below in connection with the situation shown in FIG. 3, viz. immediately after the diver is finished with the inhalation. The arrows in the cylinder body 21 show the direction of the gas flow (towards the inhalation valve 17) just before the spring 33 pulls the piston 23 back to its intermediate position in the channel 22. After finished inhalation and exhalation the piston 23, because of the spring 33 is pulled back from its respective extreme positions wherein the channel 22 is completely open, and the switching means is adjusted in such a manner that the tilting member 62 of the pivot arm 31 depresses the adjacent end of the respective lever 40 or 41 (and the associated switching valve 38 or 39 is thereby opened) just before the piston 23 is moved into and closes the channel 22. This returning movement of the piston 23 has just taken place in FIG. 3. This movement of the piston was transferred to the pivot arm 31 which was rotated about the shaft 32 whereby the tilting member 62 pushed the left end of the lever 40 downwards. Thereby the valve stem 63 with the valve disk of the switching valve 38 was pulled upwards and opened for high-pressure gas from the left chamber 34 to the right side of the piston 54. Thereby the piston 54 instantaneously was pushed to the left and brought with it the pivot arm 55 which was rotated about the shaft 56 to its other switching position.

Immediately before this happened, there was an overpressure in the chamber 34 since the pivot arm 55 was in a position wherein it pressed the valve 42 in the chamber 34 to open position, i.e. with the chamber 34 in open connection with the compressed gas source 45. In the illustrated position, the overpressure is now instead directed to the right chamber 35 through the opened valve 43. At the same moment as this switching has been effected, the remaining overpressure in the chamber 34 is let out through the outlet valve 46 and further into the breathing bag 1 through the means 52, or directly out to the surroundings through the overpressure valve 50.

What has been achieved with this switching, is that the overpressure from the gas source 45 has been directed from the outlet 36 of the chamber 34 to the outlet 37 of the chamber 35 and thereby into the pneumatic cylinder 6 on the opposite side of the piston 7, viz. from the inlet 10 to the inlet 11. Simultaneously, the arrangement is such that the gas located on that side of the pneumatic cylinder 6 having no overpressure is directed into the breathing bag 1 or possibly out to the surroundings. Before this switching took place, the breathing bag had overpressure and was able to provide the diver with breathing gas. After the switching there is a negative pressure in the breathing bag which is ready to suck in the gas blown out by the diver.

When the diver has finished the inhalation, the spring 33 pulls the piston 23 back to said intermediate position in the channel 22. When the diver thereafter exhales, the piston 23 is pushed to the right and opens for the passage of gas from the diver into the breathing bag 1. The pivot arm 31 is rotated further clockwise, and the tilting member 62 is simultaneously rotated anticlockwise and is transferred to the adjacent end of the left lever 41, the right lever 40 returning to its rest position and the switching valve 38 being closed.

Immediately after the diver has finished the exhalation, the piston 23 of the sensing means is moved back towards the channel 22, and switching then again occurs instantaneously, the switching valve 39 being opened so that the piston 54 is pushed to the right and the pivot arm 55 affects the valves 42, 43 and 46, 47, whereby the overpressure from the gas source 45 is switced from the chamber 35 to the chamber 34 and concequently from the inlet 11 to the inlet 10 of the pneumatic cylinder 6.

Instead of the completely mechanical switching mechanism shown in FIG. 3, there may be used an electronically controlled mechanism, provided that supply of electric power is ensured. Also with such a solution it may be natural to use a spring-loaded piston which the gas flow must push aside to be able to pass. Further, a sensitive pressure transducer may be used to sense the pressure difference on each side of the piston. When the gas flow has stopped, there is no longer any pressure difference, and it is ready for switching. One may also allow the pressure transducer to sense the pressure at the mouthpiece of the diver in connection with the demand regulator and let the switching be controlled by whether the diver with his breathing creates an overpressure (exhalation) or a negative pressure (inhalation). The switching may advantageously take place by means of solenoid valves.

It may be a "matter of taste" which solution is chosen. The electrical solution probably will be able to afford a more rapid switching, whereas the mechanical solution on the other hand may be more safe.

In a semi-closed primary breathing system one is dependent on an effective $CO_2$ absorption and a stable $O_2$ level. It is therefor necessary with a continuous (electronic) oxygen monitoring. In an emergency breathing system this is not necessary, but one must have assurance that the oxygen level is within certain values. Unless it is chosen to equip the diver with a (rechargable) battery which can maintain the electronic control and the regulation of the $O_2$ level, the $O_2$ regulation must take place in a completely mechanical manner when the breathing bag is used as an emergency system. A suitable manner may then be to allow all gas which has passed the pneumatic cylinder, to be directed into the breathing bag. This gas quantity will exceed consumed gas in volume, and the breathing bag must be provided with a mechanism which frequently lets out "rarefied" excess gas. The oxygen level may be maintained within the given limits by filling a suitable helium/oxygen mixture on the reserve bottle. This is a simple solution when it is the question of maintaining a suitable gas mixture in the emergency breathing system.

Figure 4:
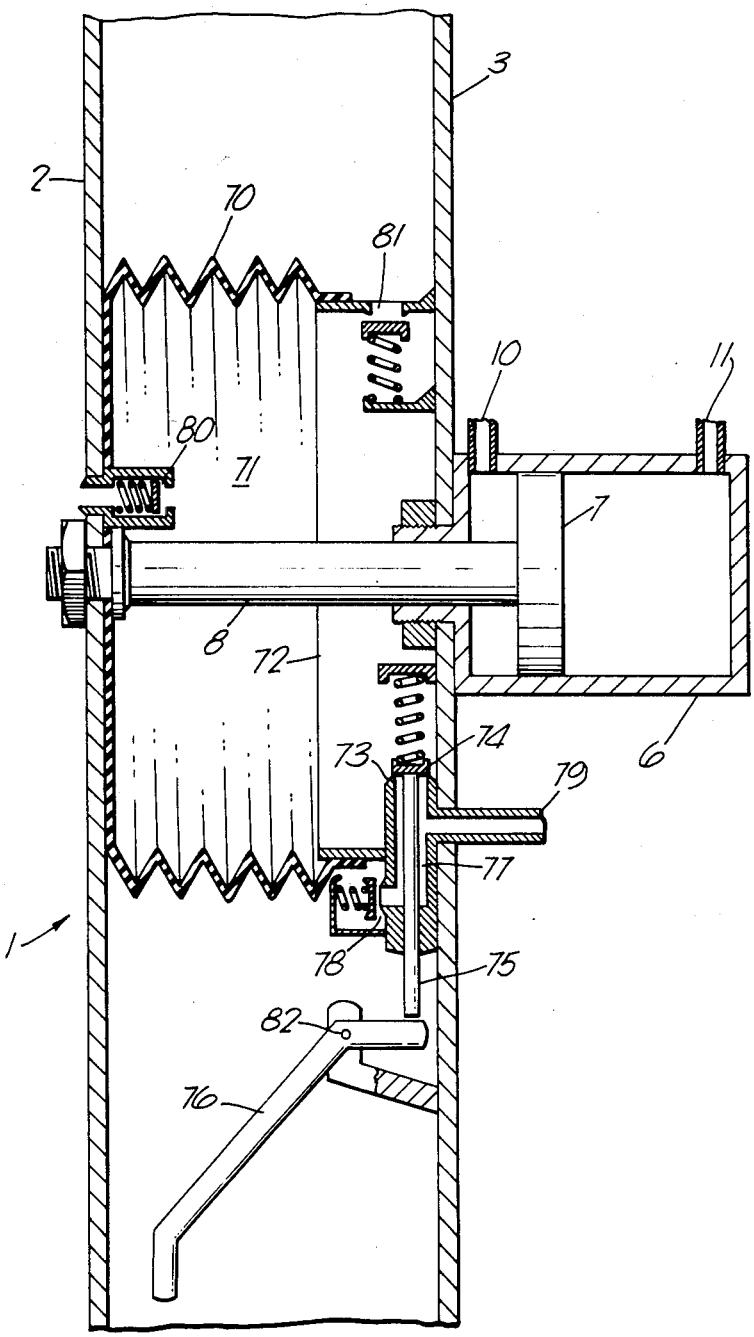
FIG. 4 shows a partial section of the breathing bag in FIG. 1 on an inlarged scale, and provided with a means for draining-off excess gas.

FIG. 4 shows an embodiment of a means taking care that the surplus gas escapes from the breathing bag. The means includes a bellows 70, e.g. of rubber, which is arranged within the breathing bag 1 so that it is compressed and expanded together with the breathing bag. Within the space 71 defined by the bellows 70 and an annular bellows support member 72 resting on one side plate 3 of the breathing bag 1, there is provided at valve 73 having a spring-loaded valve disk 74 which is operatively coupled through a valve stem 75 to one end of a pivotally mounted lever 76. The other end of the lever is arranged to be affected by the left side plate 2 of the breathing bag 1 when the breathing bag 1 is contracted beyond a certain limit. Through a chamber 77 the valve 73 communicates with a first overpressure or relief valve 78 which in turn communicates with the interior of the breathing bag 1 outside the bellows 70. The chamber 77 has an outlet 79 leading to a special means having as its task to pump fresh water into the humidifier unit of the breathing system each time the breathing bag 1 contracts, as described in detail in connection with FIG. 5.

The interior space 71 of the bellows 70 communicates with the surroundings through a second relief valve 80. An additional valve 81 serves to fill up gas in the bellows 70 from the remaining part of the breathing bag 1.

FIG. 4 shows the situation immediately after the diver has blown out and the breathing bag is "overfilled". This situation is characterized in that the side plate 2 of the breathing bag is not in contact with the lever 76 and the spring-loaded valve 73 is in closed position. What further happens, is as follows: When the diver has finished the exhalation and the switching means 12 has effected switching of the breathing bag to "suction", the diver's inhalation causes that the side plates 2, 3 of the breathing bag again move towards each other. Since the valve 73 is closed, the gas enclosed in the bellows 70 will be pressed out to the surroundings through the relief valve 80. When the side plates 2, 3 has moved a certain distance towards each other, the left side plate 2 will engage the end of the lever 76 which thereafter is rotated about a stationary shaft 82 and opens the valve 73 by way of the valve stem 75. This results in that the remaining gas in the bellows 70 passes through the valve 73 into the chamber 77 instead of being dumped to the surroundings through the valve 80. The above-mentioned pumping means which is connected to the outlet 79, will only receive a limited gas quantity before the pressure in the chamber 77 rises so that the relief valve 78 opens and leads the remaining gas quantity back to the breathing bag. Thus, the valve 78 opens at a lower overpressure than the relief valve 80.

Thus, the described device provides for automatic dumping of gas filling up the breathing bag beyond a given level, at the same time as it has an important task with respect to keeping the gas humidifier of the system in operation.

Figure 5:
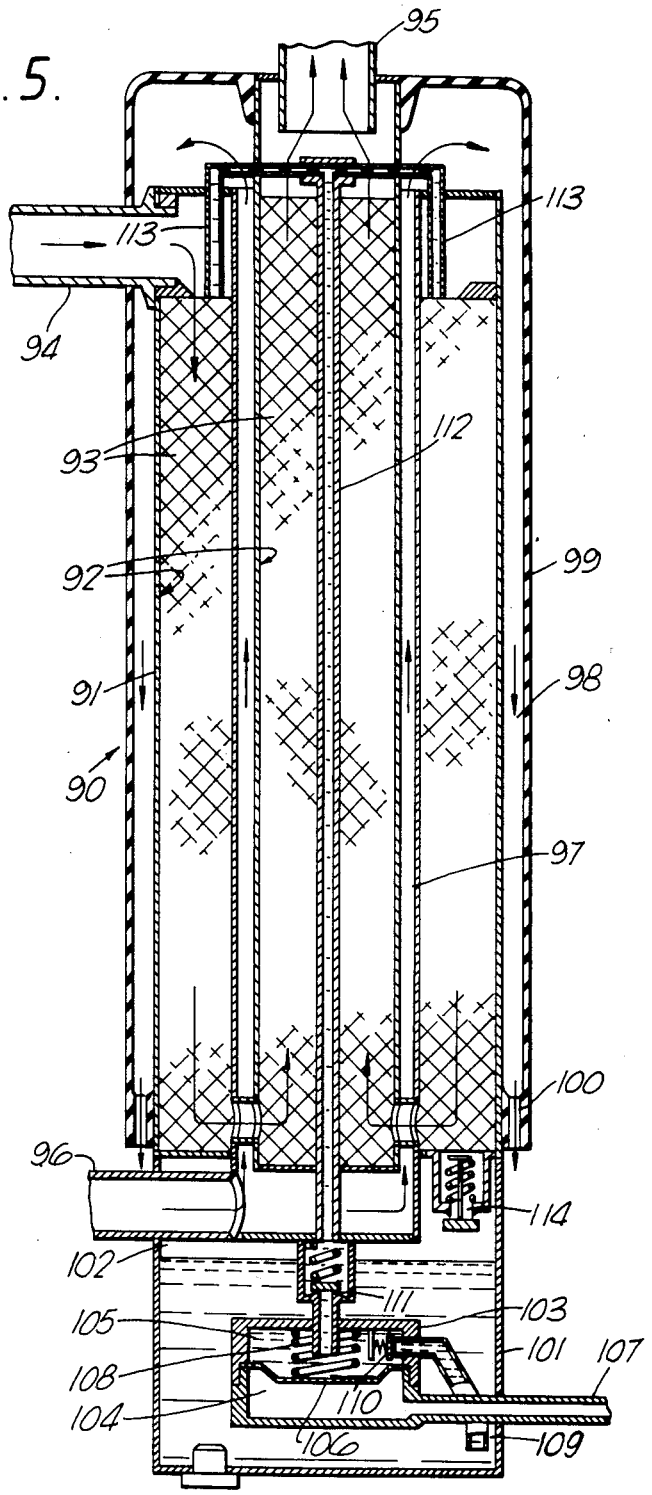
FIG. 5 shows a humidifier unit which can be used in the system according to the invention.

The humidifier unit which is to be able to be incorporated in the present breathing system, must have a large through-flow cross-section. FIG. 5 shows a schematic view in longitudinal section of such a humidifier unit 90. The unit includes a cylindrical casing 91 enclosing a plurality of longitudinally extending channels 92 filled of coarsely meshed, filter-forming metal gauze 93. At the upper end of the casing 91 there is provided an inlet tube 94 through which the gas enters the humidifier unit to be led through the metal gauze 93 in the channels 92 in the direction of the shown arrows and out through an outlet tube 95. An additional inlet tube 96 is provided at the lower end of the filter unit 92, 93, for the supply of warm water (e.g. brine) flowing through the humidifier through a number of channels or, as suggested, an annular passage 97. The water flows in the direction of the shown arrows to the upper edge of the humidifier from which the water is led downwards along the outer side of the humidifier in an annulus 98 formed between the casing 91 and an outer sleeve 99, e.g. of rubber, to a lower outlet 100.

The aforementioned means for pumping of a suitable quantity of fresh water into the humidifier unit each time the breathing bag contracts, includes a container 101 arranged at the lower end of the humidifier and having an inner space 102 for the reception of water and possibly gas and wherein there is mounted an inner container 103 which is divided into a first or lower chamber 104 and a second or upper chamber 105 by means of a diaphragm 106.

The lower chamber is provided with an inlet tube 107 connected to the outlet tube 79 from the dumping means in FIG. 4. In the upper chamber 105 there is provided a spring 108 affecting the diaphragm 106 towards a position of equilibrium. The upper chamber 105 is filled by water supplied through a tube 109 and a valve 110 opening when a negative pressure arises in the chamber 105.

Further, the upper chamber 105 is connected through a relief valve 111 with a tube 112 extending through the humidifier unit 90 and being surrounded by the coarsely meshed metal gauze 93. At its upper end the tube 112 is connected to a number of thin tubes or channels 113 debouching where the supplied gas meets the metal gauze 93. The tube 112 is to some extent perforated along its length, so that water flowing through the tube and further through the thin tubes 113 is partly also pressed out into the metal gauze located adjacent the tube.

Between the humidifier unit 90 and the inner space 102 of the container 101 there is provided a valve 114 which opens at a negative pressure in the container space to let in gas or possible surplus water located in the humidifier unit at the upper side of the valve.

The operation of the humidifier unit will be further described below.

As mentioned, breathing gas is supplied through the inlet tube 94. The gas passes through the coarsely meshed metal gauze 93 and is here supplied with water in the shape of drops which is supplied from the tubes 112 and 113 and is finely divided over the large surface constituted by the wires in the woven metal gauze. Since the gas is in good thermic contact with the hot water flowing through the humidifier unit through the passages 97 and 98, a very effective vaporization takes place.

Immediately after the diver starts the inhalation, gas with overpressure is supplied to the chamber 104 through the inlet tube 107 from the outlet 79 of the device in FIG. 4. 8because of the overpressure, the diaphragm 106 is pushed upwards and presses water located at the upper side of the diaphragm upwards through the tube 112 and further through the thin tubes or channels 113 onwards to the point where the gas meet the metal gauze 93. The coarse metal gauze allows the gas to get through relatively easily. However, pressure gradients arise which are sufficient for most of the water from the channels 113 to be entrained by the gas flow even if the humidifier is tilting "the wrong way".

Each time the diver breathes, a given amount of water is pushed into the gas stream because of the pumping action of the diaphragm 106. Each time the overpressure on the underside of the diaphragm 106 ceases, the diaphragm is returned to its position of equilibrium by the spring 108. Thereby a negative pressure is created above the diaphragm, so that the valve 110 is opened and water is sucked in through the tube 109. A possible negative pressure in the container space 102 causes in turn that the valve 114 opens and lets in gas or possible surplus water on the upper side of the valve.

As suggested in FIG. 5, the humidifier unit 90 is provided with "traps" to prevent water which has not evaporated, from flowing out of the humidifier. The pumping means normally will deliver more water than what is needed. The described mechanism itself provides for catching excessive water before there is so much that it may create problems in the system.

Figure 6:
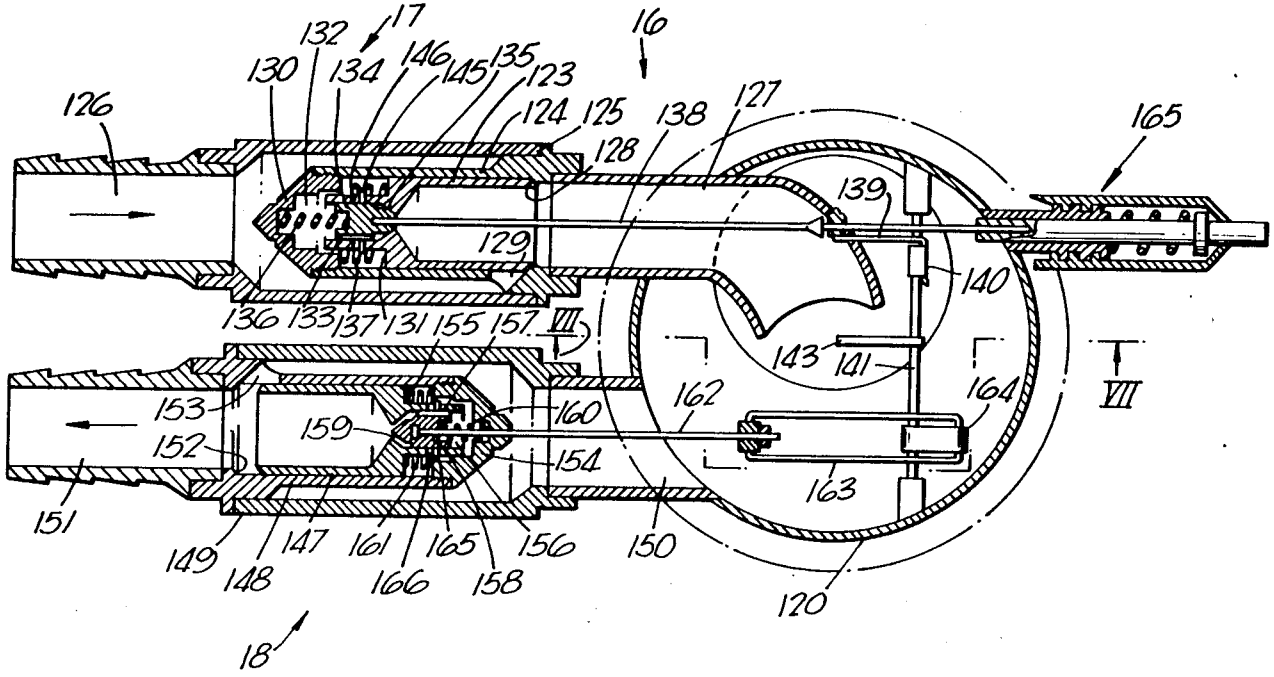
FIG. 6 shows a sectional view of a double-acting demand regulator for use in the system according to FIGS. 1-3.
Figure 7:
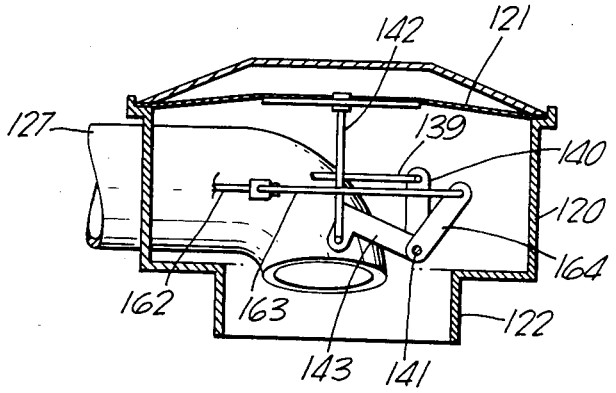
FIG. 7 shows a sectional view essentially along the line VII—VII in FIG. 6.

The double-acting demand breathing valve 16 used in the breathing system in FIGS. 1–3, is shown in FIGS. 6 and 7. This valve is developed with a view to achieving a good through-flow capacity at a low drop of pressure across the inhalation valve 17 as well as the exhalation valve 18. In addition, it is so easily regulated that the inhalation as well as the exhalation function is controlled by one and the same diaphragm. The inhalation and exhalation valve are coupled to a common valve housing 120 having a sensing diaphragm 121 which, under the influence of the pressure in the valve housing, is arranged to operate both valves 17, 18 through a respective linkage and a control rod. The valves are in a closed position when the diaphragm 121 is in an intermediate position. The valve housing 120 has a lower connecting tube 122 for connection to the diver's breathing mouthpiece or breathing mask (not shown).

The inhalation valve 17 is of per se known type and is based on the control principle according to Norwegian patent specification No. 151 447. The exhalation valve 18 is based on the same control principle, but is reconstructed in relation to the inhalation valve and is mounted in the opposite direction relative to the valve housing 120, as further described below.

The inhalation valve comprises a main piston 123 which is axially displaceable in a sleeve-shaped piston guide 124 which in turn is mounted in an outer valve housing 125 communicating with an inlet 126 and an outlet 127. One end of the piston guide has a constriction forming a valve seat 128 for a correspondingly ground end face of the main piston 123. At this end the piston guide is provided with ports 129 for through-flow of gas in open position of the valve. At its other end the piston guide 124 is closed by means of a cap 130, and between this cap and the adjacent end face 131 of the piston 123 there is formed a chamber 132 communicating with the outlet side 127 of the valve 17 through a pressure equalizing channel 133 formed through the piston 123. The pressure equalizing channel 133 can be opened and closed by means of a control valve including a valve body in the form of a control piston 134 which is displaceable in the channel 133 and co-operates with a seat 135 in the main piston 123. In the chamber 132 there is arranged a weak helical spring 136 pushing the valve body 134 towards the closed position in abutment against the seat 135, and a further weak helical spring 137 pushing the main piston 123 towards the closed position in abutment against the seat 128.

The valve 17 is arranged to be opened and closed by means of an operating rod or control rod 138 extending axially through the main piston 123. The rod is connected at one end to the valve body 134 of the control valve, and at its other end the rod is coupled to the sensing diaphragm 121 through said linkage. The linkage comprises a link arm 139 connected through the control rod 138 and an arm 140 fixed to a transverse shaft 141 in the valve housing 120. The diaphragm 121 is centrally provided with a depending arm 142 which is coupled to the shaft 141 through a main transfer arm 143.

As appears from FIG. 6, the valve body 134 of the control valve is provided with a pair of protruding pins 145 inserted in short, axial slots 146 in the main piston 123. This arrangement results in that the control rod 138, by movement to the left, firstly opens the control valve 134, 135, and that the valve body 134 thereafter, by further movement of the control rod to the left, brings along the main piston 123 and thereby opens the valve 17 when the protruding pins 145 are brought into engagement with the main piston at the ends of the slots 146.

In a manner corresponding to that of the inhalation valve 17, the exhalation valve 18 includes a main piston 147, a piston guide 148, a valve housing 149 having an inlet 150 and an outlet 151, a valve seat 152 for the main piston 147, ports 153 provided in the piston guide 148 for through-flow of gas, a cap 154 closing the piston guide, a chamber 156 formed between the cap 154 and the adjacent end face 155 of the piston 147, a pressure equalizing channel 157 through the piston 147, a control valve comprising a valve body 158 and a valve seat 159, and helical springs 160 and 161 for affecting the control valve body 158 and the main piston 147, respectively, towards the closed position.

The exhalation valve 18 is arranged to be opened and closed by means of an operating rod or control rod 162. However, this rod is taken through the cap 154 forming the right end face in the chamber 156, in contradistinction to the control rod 138 of the inhalation valve 17, which rod is taken axially through the main piston 123 in that valve. This has connection with the fact that the inhalation valve 17 is controlled from the low-pressure side, whereas the exhalation valve 18 is controlled from the high-pressure side (The inlet 126 is based on an overpressure of 0,1 atm. in relation to the valve housing 120 whereas the outlet 151 has a negative pressure of 0,1 atm.) Apart from the carrying-through of the control rods 138, 162 in relation to the main piston, the inhalation and exhalation valves are identical, but are assembled in the opposite direction relative to the valve housing 120.

The linkage between the control rod 162 of the exhalation valve and the sensing diaphragm 121 comprises a link arm or stirrup 163 between the control rod and an arm 164 which is fixed to the transverse shaft 141 in the valve housing 120.

In a manner corresponding to that of the control valve body 134 in the inhalation valve 17, the control valve body 158 in the exhalation valve 18 is provided with protuding pins 165 inserted in short, axial slots 166 in the main piston 147.

In FIG. 6, the exhalation valve 18 of the demand regulator 16 is shown in open position, the diver being in progress of blowing out. His breathing has created a small overpressure in the valve housing 120, so that the diaphragm 121 has been moved upwards. Accordingly, the main transfer arm 143 has rotated the shaft 141 clockwise, so that the control rod 162 through the arm 164 and the stirrup 163 has been pulled to the right.

The first thing that happens when the diver blows out, is that the valve body 158 of the control valve is pulled away from the seat 159. (The breathing system takes care that the outlet 151 of the exhalation valve 18 always has a lower pressure than the valve housing 120 when the diver is in the exhalation phase.) As a result of the fact that the valve body 158 is moved away from the seat, the pressure equalizing channel 157 between the chamber 156 and the outlet 151 is opened. The pressure difference between the chamber and the outlet is then instantaneously reduced, and the main piston 147 of the exhalation valve can then be moved with a minimum of force, and thereby regulate the through-flow of gas. The chamber 156 gets a certain filling-up of gas through a leakage between the main piston 147 and the piston guide 148. This leakage is small and does not manage to build up the pressure in the chamber 156 as long as the valve body 158 is pulled to the right. The leakage is, however, sufficiently large for the chamber 156 to obtain the same pressure as the valve housing 120 a fraction of a second after the control valve body 158 has been returned to its seat.

By pulling the control valve body 158 away from its seat 159 in the main piston 147, the (main part of the) pressure forces attempting to press the main piston 147 against the seat 152, are (is) eliminated.

It will be appreciated that the inhalation valve 17 functions according to exactly the same principle, but it is now a negative pressure in the breathing which causes the sensing diaphragm 121 to be pulled downwards and to bring the shaft 141 to rotate counterclockwise, so that the control rod 138 of the inhalation valve is pushed to the left and controls the inhalation valve.

In FIG. 6 there is also shown a push button means 165 (left out in FIG. 7) which, when depressed, causes supplied gas to flow freely through the inhalation valve 17. This push button may for example be used to push gas into the lungs of an unconscious diver.

In the embodiment of the breathing system shown in FIGS. 1–4, the overpressure in the breathing bag 1 in principle is maintained essentially constant as long as the diver inhales, and the gas supply is regulated by means of the demand breathing valve. Correspondingly, the negative pressure in the breathing bag is maintained essentially constant as long as the diver exhales, the regulation of the valve corresponding therewith.

In the following there will be described an embodiment of the breathing system wherein the breathing pattern of the diver is sensed by a sensing diaphragm which, by means of a switching and control device, regulates the gas to the pneumatic cylinder in such a manner that the breathing bag does not have a larger overpressure and negative pressure, respectively, than what is necessary for the gas to be directed to and from the diver through approximately open hose connections.

Figure 8:
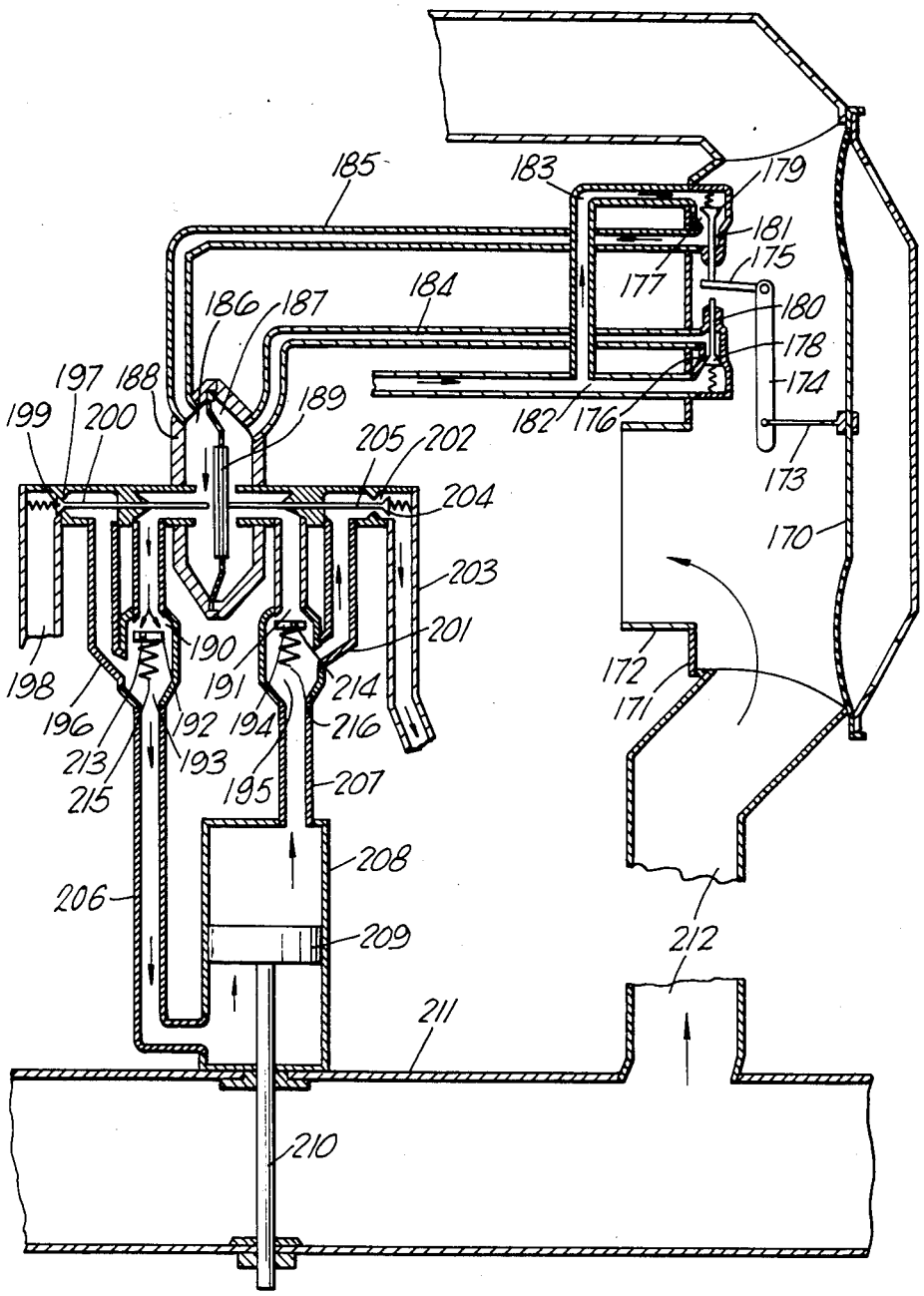
FIG. 8 shows a sectional view of a further embodiment of a breathing system according to the invention.

Such an embodiment is schematically shown in FIG. 8. Said sensing diaphragm 170 is mounted in a valve housing 171 having a connecting piece 172 for connection to the diver's breathing mouthpiece or breathing mask (not shown). The diaphragm is connected through an arm or stirrup 173 with one end of a lever 174 of which the other end has a transversly projecting arm 175 which is arranged to affect a first and a second valve 176 and 177, respectively, the valves having spring-loaded valve bodies 178 and 179, respectively, with respective valve stems 180 and 181 of which the ends are arranged to be affected by said arm 175. The valves 176, 177 have respective inlets which, through supply tubes 182 and 183, respectively, communicate with the compressed gas source (not shown) of the breathing system. The outlets of the valves 176, 177 are connected through respective outlet tubes 184, 185 to a left and a right chamber 186 and 187, respectively, of a housing 188 which is divided into said chambers by means of a diaphragm 189. The left chamber 186 of the housing 188 is connected through an outlet with a first one-way valve 190, whereas the right chamber 187 is connected through an outlet with a second one-way valve 191. The first valve 190 has a spring-loaded valve body 192 which is opened towards a chamber 193, whereas the second valve 191 has a spring-loaded valve body 194 which is opened towards a chamber 195. The outlet chamber 193 of the first valve 190 is connected through a tube connection 196 with the inlet of a first outlet valve 197 having an outlet 198 and a spring-loaded valve body 199 which, through a valve stem 200, is operatively coupled to the diaphragm 189 in the housing 188. The outlet chamber 195 of the second oneway valve 191 is connected through a tube connection 201 to the inlet of a second outlet valve 202 having an outlet 203 and a spring-loaded valve body 204 which, through a valve stem 205 is operatively coupled to the diaphragm 189 in the housing 188.

The two outlet chambers 193 195 are connected through respective additional tube connections 206 and 207 to respective ends of the pneumatic cylinder 208 of the system. The cylinder piston 209 has a piston rod 210 which is coupled to the breathing bag 211 of the system in a similar manner to that of the embodiment according to FIGS. 1–3. The breathing bag 211 is connected to the valve housing 171 through a hose or tube 212.

The operation of the system according to FIG. 8 will be described below.

When the diver breathes, a negative pressure is created in the valve housing 171 so that the diaphragm 170 is moved inwards in the valve housing (to the left in FIG. 8). The movement of the diaphragm is transferred through the lever 174 and the arm 175 to the valve body 179 in the valve 177 which opens for the supply of high-pressure gas which flows through the valve to the chamber 186 on the left side of the diaphragm 189 in the housing 188. The diaphragm is pressed to the right and thereby pushes the valve stem 205 in the valve 202 to the right, so that the valve opens. This provides an open connection between the cylinder space on the upper side of the pneumatic piston 209 and the outlet 203 from the outlet valve 202. From said chamber 186 the gas flows further through the one-way valve 190 and into the cylinder 208 at the underside of the pneumatic piston 209. The piston 209 is pressed upwards and causes a contraction of the breathing bag 211, and gas from the breathing bag is thereby pushed into the valve housing 171 through the hose 212.

When the diver breathes heavily, the valve 177 is further opened. Consequently, more gas flows into the cylinder 208 at the underside of the piston 209, and the gas flow from the breathing bag 211 to the valve housing 171 increases. Thus, the system functions as a demand system.

When the diver blows out (exhales), the diaphragm 170 is pushed outwards (to the right in FIG. 8). This movement is transferred to the arm 175 which pivots downwards so that the valve 177 closes and the valve 176 opens. High-pressure gas now flows through the valve 176 to the chamber 187 on the right side of the diaphragm 189 in the housing 188. The diaphragm is pressed to the left so that the outlet valve 202 is closed and the outlet valve 197 is opened. The underside of the pneumatic piston 209 now is in essentially open connection with the outlet 198. Simultaneously, high-pressure gas flows through the one-way valve 191 and into the cylinder 208 on the upper side of the piston 209. The piston is pressed downwards so that the breathing bag 211 is expanded and sucks in exhaled gas through the hose 212. The regulating mechanism ensures that also the expansion of the breathing bag follows the breathing pattern of the diver, so that the system also in this case functions as a demand system.

The one-way valves 190 and 191, of which each is provided with a small "leakage channel" 213 respectively 214 through the valve bodies 192, 194, serve to ensure that the switching between inhalation and exhalation takes place as quickly as possible. In the short moment when the diver has finished inhalation or exhalation, the gas flow ceases since the valves 176 and 177 are both closed. The pressure difference between the upper side and the underside of the piston 209 is instantaneously equalized. The small leakage channels 213 and 214 further serve to ensure that the pressure difference between the chambers 186 and 187 is quickly reduced.

The springs 215 and 216 closing the one-way valves 190 and 191, are somewhat stiff. This results in that a gas flow from the valve 176 or 177 quickly builds up a new pressure difference between the chambers 186 and 187 and affects the diaphragm 189 so that the switching is complete in a very short time. With complete switching it is meant that the high-pressure gas is directed into the pneumatic cylinder 208 on the opposite side of the piston 209, and that the outlet channel for that side of the cylinder to which gas is not supplied, is opened, which means that the outlet valve 197 or 202 is opened.

The exhaust gas, which is expelled through the outlets 198 and 203, is fully or partly directed into the breathing bag to compensate for leaked-out and consumed gas, in a manner corresponding to that of the embodiment according to FIGS. 1–4. How large portion of the gas mixture that is to be supplied to the breathing bag, particularly depends on the gas mixture on which the use of the system is based.

I claim:

1. A self-contained breathing apparatus for divers, comprising:

a variable volume breathing bag (1; 211) for delivering inhalation gas to and receiving exhalation gas from the diver, said bag being connected to a valve housing (120; 171) for connection to a mouthpiece or a breathing mask for the diver, a pneumatic cylinder/piston unit (5; 208, 209) of which the piston (7; 209) is operatively coupled to said breathing bag (1; 211), to compress or expand the bag, a compressed gas source (45) connected to said breathing bag (1; 211) for supplementing the breathing gas therein as required, and further connected to said cylinder/piston unit (5; 208, 209) at a first and a second side of the piston (7; 209), a sensing means (20; 170) arranged to respond to pressure variations in the breathing gas caused by the diver terminating inhalation or exhalation, a switching means (12; 173-205) arranged to be actuated by said sensing means (20; 170), so that it switches said compressed gas source (45) to either side of said piston (7; 209) in accordance with the breathing pattern of the diver, and a control means (16; 170-177) arranged to maintain the breathing gas pressure in said valve housing (120; 171) stable and approximately equal to the ambient pressure, said control means (16; 170-177) including a sensing diaphragm (121; 170) disposed in said valve housing (120; 171) and forming part of a sensitive low-pressure demand regulator controlled by the diver's breathing pattern and causing breathing gas to be carried to the diver from said breathing bag (1; 211) and from the diver to said breathing bag in accurate correspondence with the demand of the diver.

2. A breathing apparatus according to claim 1, wherein said sensing diaphragm (170) also constitutes said sensing means, said diaphragm being arranged to move in opposite directions in dependence on whether the diver inhales or exhales, and being operatively coupled to the switching means (173–205) so that high-pressure gas is supplied through the switching means to either side of said piston (209) in dependence on the position of said diaphragm (170), said control means (176, 177) being arranged to provide for increasing or decreasing the high-pressure gas flow to said pneumatic cylinder (208) in correspondence with the extent of movement of the diaphragm (170) in the appropriate direction.

3. A breathing apparatus according to claim 1, wherein said control means is constituted by said low-pressure demand regulator (16), and said sensing means (20) is arranged to sense when the diver has terminated inhalation or exhalation and causes said switching means (12) immediately to switch said compressed gas source (45) to the other side of said piston (7), so that said cylinder/piston unit (5) causes said breathing bag (1) to maintain an essentially fixed over-pressure during the diver's inhalation and a corresponding essentially fixed negative pressure during the diver's exhalation.

4. A breathing apparatus according to claim 3, wherein said demand regulator (16) is designed as a double-acting breathing valve wherein an inhalation valve (17) and an exhalation valve (18) are coupled to said valve housing (120) with said sensing diaphragm (121) which, under the influence of the pressure in the valve housing (120), is arranged to operate both valves (17, 18) through a respective linkage (139–143 resp. 141–143, 163, 164) and a control rod (138 resp. 162) coupled to a valve body (134 resp. 158) in a control valve (134, 135 resp. 148, 159) in the operative valve (17 resp. 18) each valve (17 resp. 18) comprising a piston (123 resp. 147) which is axially displaceable in a piston guide (124 resp. 148) of which one end has a constriction forming a seat (128 resp. 152) for the piston, and of which the second end is closed and together with an end surface (131 resp. 155) of the piston (123 resp. 147) define a chamber (132 resp. 156) communicating with the outlet side (127 resp. 151) of the valve through a pressure equalizing channel (131 resp. 157), said control valve after opening by means of its control rod (138 resp. 162) causing a pressure equalization on each side of the piston (123 resp. 147), so that the piston thereafter can be moved away from its seat (128 resp. 152) with a minimum drop of pressure across the valve (17 resp. 18).

5. A breathing apparatus according to claim 3, wherein the control valve (134, 135) of said inhalation valve (17) is arranged to be opened in that the associated control rod (138) moves the control valve body (13) in the direction away from the seat (128) of the valve piston (123) and in the direction away from the common valve housing (120), and the control rod (138) thereafter by continued movement in the same direction, moves the valve piston (123) away from its seat (128) to open position of the valve (17), and wherein the piston (147) of said exhalation valve (18) is oppositely oriented in relation to the piston (123) of said inhalation valve (17), and its control valve (158, 159) is arranged to be opened in that is control rod (162) moves the control valve body (158) in the direction away from the seat (159) of the valve body and therewith in the direction towards said valve housing (120).

6. A breathing apparatus according to one of claim 15–17, wherein said sensing means (20) is connected between said breathing bag (1) and said demand regulator (16) and includes a hollow body (21) in which there is provided a channel (22) having a piston (23) which is displaceable therein, the piston (23) being coupled to a spring (33) arranged to move the pistons (23) being coupled to a spring (33) arranged to move the piston (23) to an intermediate position in the channel (22) when the piston (23) is not affected by a pressure force from flowing gas, the piston (23) further being coupled to an actuating means (31, 40, 41, 62) forming part of said switching means (12) and being arranged to cause said switching of the compressed gas source (45) immediately before the piston (23), responsive to the spring (33), is reintroduced in the channel (22) after finished exhalation and inhalation, respectively.

7. A breathing apparatus according to claim 6, wherein said switching means (12) includes first and second chambers (34, 35) having a respective switching valve (38 resp. 39) arranged to be opened by said actuating means (31, 40, 41, 62), and having a respective, further valve (42, 43) communicating with said compressed gas source (45), and a piston (54) which is driven in opposite directions by the opening of the two switching valves (38, 39), and is coupled to a pivot arm (55) which, in switching-over of the piston (54), switches the compressed gas source (45) from one chamber (34 resp. 35) to the other, so that the compressed gas source (45) is switched from one inlet (10 or 11) of the pneumatic cylinder (6) to the other inlet.

8. A breathing apparatus according to one of claims 13–17 including a means arranged to let surplus gas out of the breathing bag (1), which means comprises a bellows (70) disposed in the breathing bag (1) and which is arranged to be compressed and expanded together with the breathing bag (1), a valve (73) arranged between the interior of the bellows (70) and the breathing bag space outside of the bellows, and a lever means (76) which is operatively connected to said valve (73) and is arranged to be affected when the breathing bag (1) is contracted beyond a certain limit, to thereby open said valve (73).

9. A breathing apparatus according to claim 8, and provided with a humidifier unit (90) for humidifying the breathing gas to the diver, wherein said valve (73) communicates through a chamber (77) with a relief valve (78) which in turn communicates with the interior of the breathing bag (1) outside of the bellows (70), and wherein said chamber (77) has an outlet (79) leading to a means (103–110) arranged to pump fresh water into said humidifier unit (90) each time the breathing bag (1) contracts.

10. A breathing apparatus according to claim 9, wherein said humidifier unit (90) includes a number of channels (92) containing coarsely meshed metal gauze (93), a means (94, 95) for the through-flow of gas through said channels (92), a tube means (112, 112) for the supply of water to the metal gauze (93) in the channels (92), so that the gas is supplied with water in the form of finely divided drops during its passage through the metal gauze (93), and a water container (101) having an inner container (103) which is divided into a first (104) and a second (105) chamber by means of a diaphragm (106), said chamber (104) being provided with an inlet tube (107) which is connected to the outlet (79) form said chamber (77) between the interior of the bellows (70) and the breathing bag space outside of the bellows (70), a spring (108) being provided in the second chamber (105) and actuating a movement of the diaphragm (106) towards a position of equilibrium, and said second chamber (105) being filled with water which is supplied to said tube means (112, 113) when high-pressure gas is supplied to said first chamber (104) through said inlet tube (107).

* * * * *